US005358820A

United States Patent [19]

Bugner et al.

[11] Patent Number: 5,358,820

[45] Date of Patent: Oct. 25, 1994

[54] THERMALLY ASSISTED TRANSFER PROCESS FOR TRANSFERRING ELECTROSTATOGRAPHIC TONER PARTICLES TO A THERMOPLASTIC BEARING RECEIVER

[75] Inventors: Douglas E. Bugner, Rochester, N.Y.; David S. Hays, Newark, Ohio; Jeanne E. Kaeding; Steven J. Spinelli, both of Rochester, N.Y.

[73] Assignee: Eastman Kodak Company, Rochester, N.Y.

[21] Appl. No.: 976,071

[22] Filed: Nov. 13, 1992

[51] Int. Cl.[5] ..... G03G 13/14

[52] U.S. Cl. ..... 430/126

[58] Field of Search ..... 430/126, 66, 67, 99

[56] References Cited

U.S. PATENT DOCUMENTS

| | | | |
|---|---|---|---|
| 3,592,642 | 7/1971 | Kaupp | 96/1.4 |
| 3,859,090 | 1/1975 | Yoerger et al. | 96/1.5 |
| 3,893,761 | 7/1975 | Buchan et al. | 355/3 R |
| 3,901,700 | 8/1975 | Yoerger et al. | 96/1 R |
| 3,975,352 | 8/1976 | Yoerger et al. | 260/33.8 |
| 3,993,825 | 11/1976 | Buchan et al. | 428/216 |
| 4,015,027 | 3/1977 | Buchan et al. | 427/24 |
| 4,663,259 | 5/1987 | Fujimura et al. | 430/58 |
| 4,748,474 | 5/1988 | Kurematsu et al. | 355/15 |
| 4,772,526 | 9/1988 | Kan et al. | 430/58 |
| 4,792,507 | 12/1988 | Yoshihara et al. | 430/58 |
| 4,803,140 | 2/1989 | Hiro | 430/58 |
| 4,847,175 | 7/1989 | Pavlisko et al. | 430/58 |
| 4,863,823 | 9/1989 | Hiro et al. | 430/58 |
| 4,869,982 | 9/1989 | Murphy | 430/48 |
| 4,927,727 | 5/1990 | Rimai et al. | 430/99 |
| 4,968,578 | 11/1990 | Light et al. | 430/126 |
| 4,990,418 | 2/1991 | Mukoh et al. | 430/56 |
| 4,996,125 | 2/1991 | Sakaguchi et al. | 430/66 |
| 5,037,718 | 8/1991 | Light et al. | 430/126 |
| 5,043,242 | 8/1991 | Light et al. | 430/126 |
| 5,045,424 | 9/1991 | Rimai et al. | 430/126 |
| 5,102,768 | 4/1992 | Light et al. | 430/126 |

FOREIGN PATENT DOCUMENTS

| | | |
|---|---|---|
| 361346A | 9/1988 | European Pat. Off. . |
| 389193A | 3/1989 | European Pat. Off. . |
| 345737A3 | 6/1989 | European Pat. Off. . |
| 356933A2 | 8/1989 | European Pat. Off. . |
| 48-093343A | 12/1973 | Japan . |
| 53-146631 | 5/1977 | Japan . |
| 54-026740A | 2/1979 | Japan . |
| 54-027434A | 3/1979 | Japan . |
| 63074693A | 9/1986 | Japan . |

*Primary Examiner*—John Goodrow

*Attorney, Agent, or Firm*—Willard G. Montgomery

[57] ABSTRACT

A method is provided for non-electrostatically transferring dry toner particles which comprise a toner binder and have a particle size of less than 8 micrometers from the surface of an element to a receiver. The element comprises a conductive substrate and a surface layer which contains an electrically insulating polymeric binder resin matrix which comprises a crystalline side chain polyester or a block copolyester or copolycarbonate having a crystalline side chain polyester block and the receiver comprises a substrate having a coating of a thermoplastic addition polymer on a surface of the substrate in which the Tg of the polymer is less than approximately 10° C. above the Tg of the toner binder. The method involves contacting the toner particles with the receiver which is heated to a temperature such that the temperature of the thermoplastic polymer coating on the receiver substrate during transfer is at least approximately 15° C. above the Tg of the thermoplastic polymer whereby virtually all of the toner particles are transferred from the surface of the element to the thermoplastic polymer coating on the receiver substrate and the thermoplastic polymer coating is prevented from adhering to the element surface during transfer in the absence of a layer of a release agent on the thermoplastic polymer coating or the element. After transfer, the receiver is separated from the element while the temperature of the thermoplastic polymer coating is maintained above the Tg of the thermoplastic polymer.

32 Claims, No Drawings

THERMALLY ASSISTED TRANSFER PROCESS FOR TRANSFERRING ELECTROSTATOGRAPHIC TONER PARTICLES TO A THERMOPLASTIC BEARING RECEIVER

FIELD OF THE INVENTION

This invention relates to an improved method of non-electrostatically transferring dry toner particles which comprise a toner binder and have a particle size of less than 8 micrometers from the surface of an element to a receiver. More particularly, the invention relates to a thermally assisted method of transferring such toner particles where the particles are carried on the surface of an element which comprises a conductive support and a surface layer which contains an electrically insulating polymeric binder resin matrix which comprises, or which includes as an additive, a crystalline side chain polyester or a block copolyester or copolycarbonate having a crystalline side chain polyester block to a receiver which comprises a substrate having a coating of a thermoplastic addition polymer on a surface of the substrate in which the Tg of the thermoplastic polymer is less than approximately 10° C. above the Tg of the toner binder by contacting the toner particles with the receiver which is heated to a temperature such that the temperature of the thermoplastic polymer coating during transfer is at least approximately 15° C. above the Tg of the thermoplastic polymer. After transfer, the receiver is immediately separated from the element while the temperature of the thermoplastic polymer coating is maintained at a temperature which is above the Tg of the thermoplastic polymer.

BACKGROUND

In an electrostatographic copy machine, an electrostatic latent image is formed on an element. That image is developed by the application of an oppositely charged toner to the element. The image-forming toner on the element is then transferred to a receiver where it is permanently fixed, typically, by heat fusion. The transfer of the toner to the receiver is usually accomplished electrostatically by means of an electrostatic bias between the receiver and the element.

In order to produce copies of very high resolution and low granularity, it is necessary to use toner particles that have a very small particle size, i.e., less than about 8 micrometers. (Particle size herein refers to mean volume weighted diameter as measured by conventional diameter measuring devices such as a Coulter Multisizer, sold by Coulter, Inc. Mean volume weighted diameter is the sum of the mass of each particle times the diameter of a spherical particle of equal mass and density, divided by total particle mass.) However, it has been found that it is very difficult to electrostatically transfer such fine toner particles from the element to the receiver, especially when they are less than 6 micrometers in diameter. That is, fine toner particles frequently do not transfer from the element with reasonable efficiency. Moreover, those particles which do transfer frequently fail to transfer to a position on the receiver that is directly opposite their position on the element, but rather, under the influence of coulombic forces, tend to scatter, thus lowering the resolution of the transferred image and increasing the grain and mottle. Thus, high resolution images of low granularity require very small particles, however, images having high resolution and low granularity have not been attainable using electrostatically assisted transfer.

In order to avoid this problem, it has become necessary to transfer the toner from the element to the receiver by non-electrostatic processes. One such process is the thermally assisted transfer process where the receiver is heated, typically to about 60 to about 90° C., and is pressed against the toner particles on the element. The heated receiver sinters the toner particles causing them to stick to each other and to the receiver thereby effecting the transfer of the toner from the element to the receiver. The element and receiver are then separated and the toner image is fixed, e.g., thermally fused to the receiver. For details, see U.S. Pat. No. 4,927,727 to Rimai et al.

While the thermally assisted transfer process does transfer very small particles without the scattering that occurs with electrostatic transfer processes, it is sometimes difficult to transfer all of the toner particles by this process. The toner particles that are directly on the element often experience a greater attractive force to the element than they do to the receiver and to other toner particles that are stacked above them, and the heat from the receiver may have diminished to such an extent by the time it reaches the toner particles next to the element that it does not sinter them. As a result, the toner particles that are in contact with the element may not transfer. Attempts to solve this problem by coating the element with a release agent have not proven to be successful because the process tends to wipe the release agent off the element into the developer which degrades both the developer and the development process. Moreover, because the process tends to wipe the release agent off the element, the application of additional release agent to the element is periodically required in order to prevent the toner particles from adhering to the element during transfer.

An alternative approach utilized in the past for removing all of the toner particles from the element was to use a receiver that had been coated with a thermoplastic polymer. During transfer, the toner particles adhered to or became partially or slightly embedded in the thermoplastic polymer coating and were thereby removed from the element. However, it was found that many thermoplastics that were capable of removing all of the toner particles also tended to adhere to the element. This, of course, not only seriously impaired image quality but it also had the potential of damaging both the element and the receiver. Moreover, it was not possible to predict with any degree of certainty which thermoplastic polymers would remove all of the toner particles from the element without sticking to the element during transfer and subsequent separation of the receiver from the element and which ones would not.

Efforts to overcome these problems first focused on applying a layer of a release agent to the surface of the thermoplastic polymer coating on the receiver substrate and heating the receiver above the Tg of the thermoplastic polymer during transfer as described in U.S. Pat. No. 4,968,578 to Light et al. The release agent prevented the thermoplastic polymer coating from adhering to the element, but it would not prevent the toner from transferring to the thermoplastic polymer coating on the receiver and virtually all of the toner was transferred to the receiver. This constituted a significant advancement in the art because it was now possible not only to obtain the high image quality that was not previously attainable when very small toner particles were transferred electrostatically but, in addition, the problem of incomplete transfer was avoided. In addition, several other advantages were provided by this process. One such advantage was that copies made by this process could be given a more uniform gloss because all of the receiver was coated with a thermoplastic polymer, (which could be made glossy) while, in receivers that were not coated with a thermoplastic polymer, only those portions of the receiver that were covered with toner could be made glossy and the level of gloss varied with the amount of toner. Another advantage of the process was that when the toner was fixed, it was driven more or less intact into the thermoplastic polymer coating rather than being flattened and spread out over the receiver. This also resulted in a higher resolution image and less grain. Finally, in images made using this process, light tended to reflect from behind the embedded toner particles that were in the thermoplastic layer which caused the light to diffuse more making the image appear less grainy.

For all of the benefits and advantages provided by this process, however, the application of a release agent to the thermoplastic polymer coating on the receiver in order to prevent the thermoplastic polymer coating from adhering to the surface of the element during transfer and subsequent separation of the receiver from the element created several problems. One such problem was that the release agent tended to transfer to and build up on the element or photoconductor thereby degrading image quality and causing potential damage to both the element and the receiver. Another problem was that the release agent tended to allow the thermoplastic polymer coating to separate from the support or substrate, especially during or after finishing, due to a reduction in the adhesion strength of the thermoplastic polymer coating to the receiver support caused by the tendency of the release agent, which had a lower surface energy than the thermoplastic polymer coating and hence a lesser predilection to adhere to the receiver support than the thermoplastic polymer coating, to migrate through the thermoplastic polymer coating to the interfacial region between the thermoplastic polymer coating and the support and to cause the thermoplastic polymer coating to separate from the support. It was also found that the release agent reduced the gloss of the finished image. Finally, the addition of a release agent to the thermoplastic polymer coating added to the overall cost of the process.

Recently, a technique was described in U.S. Pat No. 5,043,242 to Light et al for obviating the foregoing limitations whereby fine toner particles having a particle size of 8 micrometers or less could be transferred from the surface of an element to a thermoplastic coated receiver with virtually 100% toner transfer efficiency using the thermally assisted method of transfer without having to apply a coating or a layer of a release agent to the toner contacting surface of the thermoplastic polymer coating on the receiver substrate prior to toner transfer in order to prevent the thermoplastic polymer coating from sticking or adhering to the element surface during transfer of the toner particles from the element to the thermoplastic polymer coated receiver and during the subsequent separation of the receiver from the element. Studies revealed that by carefully selecting, as the thermoplastic polymer coated receiver, a receiver in which the thermoplastic polymer coating material was a thermoplastic addition polymer which had a glass transition temperature that was less than approximately 10° C. above the glass transition temperature of the toner binder and the surface energy of the thermoplastic polymer coating was within a range of from approximately 38 to 43 dynes/cm and, as the element on which the toner particles which were to be transferred to the receiver were carried, an element, which had a surface layer which comprised a film-forming, electrically insulating polyester or polycarbonate thermoplastic polymeric binder resin matrix and had a surface energy not exceeding approximately 47 dynes/cm, preferably 40 to 45 dynes/cm, and further, by heating the receiver to a temperature such that the temperature of the thermoplastic polymer coating on the receiver substrate during transfer was at least approximately 15° C. above the Tg of the thermoplastic polymer, it was possible to transfer such very small, fine toner particles (i.e., toner particles having a particle size of less than 8 micrometers) non-electrostatically from the surface of the element to the thermoplastic coated receiver and to obtain high resolution transferred images which were not previously attainable when such small toner particles were transferred electrostatically while at the same time avoiding the problems of incomplete transfer and adherence of the thermoplastic polymer coating to the element during toner transfer in the absence of a layer of a release agent on the thermoplastic polymer coating, i.e., without having to apply a coating or layer of a release agent to the toner contacting surface of the thermoplastic polymer coating on the receiver substrate prior to contacting the thermoplastic polymer coating with the toner particles on the element surface and transference of the particles to the receiver. Furthermore, it was found that by maintaining the temperature of the receiver such that the temperature of the thermoplastic polymer coating was maintained above the Tg of the thermoplastic polymer immediately after transfer while the receiver was separating from the element surface, the receiver would separate readily and easily from the element, while hot, without the thermoplastic polymer coating adhering to the element surface and without the prior application of a release agent to the thermoplastic polymer coating. In addition, it was further found that all of the other advantages inherent in the use of a thermoplastic polymer coated receiver in a thermally assisted transfer process were preserved by the process including the production of copies having a more uniform gloss and images having a less grainy appearance. And, finally, it was possible for the first time to determine in advance, in a thermally assisted transfer process, which thermoplastic polymers could be used as receiver coating materials which would not only remove virtually all of the toner particles from the element during transfer but, at the same time, would not adhere to the element during transfer and subsequent separation of the receiver from the element and which ones would not.

Unfortunately, this technique requires that both the image-bearing element and the thermoplastic polymer coated receiver exhibit certain limiting ranges of surface energies in order to prevent the thermoplastic polymer coated receiver from sticking to the element during the transfer of the toner particles from the element to the receiver and during the subsequent separation of the receiver from the element. For example, the image-bearing element is specified to exhibit a surface energy of less than approximately 47 dynes/cm, preferably from about 40 to 45 dynes/cm and the thermoplastic polymer coated receiver is further specified to exhibit a surface energy which is in the range of approximately 38 to 43 dynes/cm. Such requirements, of course, limit the amounts and types of materials which can be used to form the surface layer of the image-bearing element and the thermoplastic polymer coating on the receiver. Another drawback with this procedure is that it has been found that in many instances there is a tendency for certain combinations of receivers and image-bearing elements to begin sticking to each other at temperatures which are very near the temperatures at which acceptable transfer first occurs. This is especially true for images which require more than one transfer to the same sheet of thermoplastic receiver, since it has been found that the temperature at which the onset of acceptable transfer occurs for the second and subsequent transfer is several degrees higher than for the first transfer. In practice, it would be very desirable to have at least a 5° C. and, more preferably, at least a 10° C. difference in temperature between the onset of acceptable transfer and the onset of sticking. Thus, there is continued need for combinations of thermoplastic receivers and image-bearing elements exhibiting broader ranges of surface energies which can be used in the practice of the thermally assisted method of transferring small, dry toner particles from the surface of an image-bearing element to a thermoplastic polymer coated receiver which not only will effect the transfer of such small toner particles from the surface of the element to the thermoplastic polymer coated receiver without the thermoplastic polymer coating of the receiver sticking to the element surface during toner transfer in the absence of a layer or a coating of a release agent on the surface of the thermoplastic polymer coating on the receiver or the element, but which also will further expand or increase the range of temperature between the onset of acceptable transfer and the onset of sticking of the image-bearing element to the receiver.

SUMMARY OF THE INVENTION

In accordance with the present invention, the prior art limitations are effectively obviated by a novel process in which dry toner particles comprising a toner binder and having a particle size of less than 8 micrometers are non-electrostatically transferred from the surface of an image-bearing element comprising a conductive substrate and a surface layer in which the surface layer of the image-bearing element on which the toner particles are carried and from which they are to be transferred to the receiver contains an electrically insulating polymeric binder rein matrix which comprises, or which contains as an additive, a polymer containing polyester repeating units which have crystalline side chains, preferably a block copolyester or a polycarbonate containing crystalline side chain polyester block to a receiver which comprises a substrate having a coating of a thermoplastic addition polymer on a surface of the substrate in which the Tg of the polymer is less than approximately 10° C. above the Tg of the toner binder by contacting the toner particles with the receiver which is heated to a temperature such that the temperature of the thermoplastic polymer coating on the receiver substrate during transfer is at least approximately 15° C. above the Tg of the thermoplastic polymer whereby virtually all of the toner particles are transferred from the surface of the element to the thermoplastic polymer coating on the receiver substrate and the thermoplastic polymer coating is prevented from adhering to the element surface during transfer in the absence of a layer of a release agent on the thermoplastic polymer coating or on the element and, after transfer, the receiver is separated from the element while the temperature of the thermoplastic polymer coating is maintained above the Tg of the thermoplastic polymer.

It has been found that such fine toner particles can be transferred from the surface of an element to a thermoplastic polymer coated receiver with virtually 100% toner transfer efficiency using the thermally assisted method of transfer without having to apply a coating or a layer of a release agent to the toner contacting surface of the thermoplastic polymer coating on the receiver substrate prior to toner transfer in order to prevent the thermoplastic polymer coating from sticking or adhering to the element surface during transfer of the toner particles from the surface of the element to the thermoplastic polymer coated receiver and during the subsequent separation of the receiver from the element.

Further, it has been found that by utilizing as the element in the thermally assisted method of transfer, an element of the type employed herein and described above, that the surface energies of the thermoplastic addition polymer coatings used on the receiver substrates of the prior art no longer must be restricted to those having a surface energy of between about 38 and 43 dynes/cm but instead can possess surface energies ranging from approximately 10 dynes/cm to approximately 50 dynes/cm and that the element employed herein can possess surface energies ranging from approximately 20 dynes/cm to approximately 40 dynes/cm. This means that a greater number and variety of thermoplastic addition polymers can be used to form the coating materials for the receivers used henceforth in the practice of the thermally assisted transfer process and that a greater number and variety of polymeric binder resin materials can be used in the surface layers of the elements previously used in the practice of the thermally assisted transfer process than could be used in the past.

Still further, it has been found that the range of temperatures between the onset of acceptable transfer and the onset of sticking of the image-bearing element to the receiver in the practice of the thermally assisted transfer process can be greatly increased, typically from about 5° to 15° C.

Thus, viewed from one aspect, the present invention is directed to a method of non-electrostatically transferring dry toner particles which comprise a toner binder and which have a particle size of less than 8 micrometers from the surface of an element which comprises a conductive support and a surface layer having an electrically insulating polymeric binder resin matrix which comprises a crystalline side chain polyester or a block copolyester or copolycarbonate having a crystalline side chain polyester block to a receiver which comprises a substrate having a coating of a thermoplastic polymer on a surface of the substrate wherein the thermoplastic polymer is a thermoplastic addition polymer having a Tg which is less than approximately 10° C. above the Tg of the toner binder whereby virtually all of the toner particles are transferred from the surface of the element to the thermoplastic polymer coating on the receiver substrate and the thermoplastic polymer coating is prevented from adhering to the surface of the element during transfer and subsequent separation of the receiver from the element in the absence of a layer of a release agent on the thermoplastic polymer coating on the receiver substrate which comprises contacting the toner particles with the thermoplastic polymer coating on the receiver substrate and heating the receiver to a temperature such that the temperature of the thermoplastic polymer coating on the receiver during transfer is at least approximately 15° C. above the Tg of the thermoplastic polymer and thereafter separating the receiver from the element at a temperature above the Tg of the thermoplastic polymer.

There are other features and advantages of the present invention will be better understood taken in conjunction with the following detailed description and claims.

DESCRIPTION OF THE PREFERRED EMBODIMENT

The present invention constitutes an improvement in the thermally assisted method of non-electrostatically transferring very small toner particles from the surface of an element to a thermoplastic polymer coated receiver where the toner particles which are carried on the surface of the element are transferred non-electrostatically to the receiver which is heated, but not heated sufficiently to melt the particles. As is taught in previously mentioned U.S. Pat. No. 4,927,727, to Rimai et al, it is not necessary or desirable to melt the toner particles in order to achieve their transfer, but that merely fusing the toner particles to each other at their points of contact, i.e., localized regions on the individual toner particle surfaces which are in contact either with one another or with the surface upon which such a particle is transferred or deposited, is adequate to accomplish a complete, or nearly complete, transfer of the particles. Thus, the toner is not fixed during transfer, but instead is fixed at a separate location away from the element. In this manner, the higher temperatures required for fixing the toner do not negatively affect or damage the element. Since the heat required to merely sinter the toner particles at their points of contact is much lower than the heat needed to fix the toner, the element is not damaged by high temperatures during transfer.

The term "sinter" or "sintering" as used herein in relation to toner particles employed in the practice of the present invention has reference to bonding or fusion that is thermally achieved at locations of contact existing either between adjacent toner particles or between toner particles and an adjacent surface. The term "sinter" and equivalent forms is distinguished for present purposes from a term such as "melts", "melting", "melt", "melt fusion" or "heat fusion". In heat fusion, in response to sufficiently applied thermal energy, toner particles tend to lose their discrete individual identities and melt and blend together into a localized mass, as when a toner powder is heat fused and thereby bonded or fixed to a receiver.

The crux of the present invention resides in the fact that it has now been found that not only can very fine toner particles, i.e., toner particles having a particle size of less than about 8 micrometers, and more typically, 3 to 5 micrometers, be non-electrostatically transferred with virtually 100% transfer efficiency from the surface of an element to the surface of a thermoplastic polymer coated receiver using the thermally assisted method of transfer and without the necessity of having to apply a coating or a layer of a release agent to the thermoplastic polymer coating prior to toner transfer in order to prevent the thermoplastic polymer coating from adhering to the element surface during and immediately following toner transfer when the receiver separates from the element, but further that the thermoplastic addition polymers heretofore used in the art for forming the toner receiver surfaces of the receivers used in the thermally assisted method of transfer are no longer limited to those having surface energies restricted to 38 to 43 dynes/cm, and still further that the range of temperature between the onset of acceptable transfer and the onset of sticking of the image-bearing element to the receiver can be greatly increased over that of the prior art. This is primarily the result of the use of an image-bearing element which has a surface layer which comprises a film-forming, electrically insulating thermoplastic polymeric binder resin matrix comprised of a crystalline side chain polyester or a block copolyester or copolycarbonate having a crystalline side chain polyester block and a surface energy of 40 dynes/cm or less, preferably from approximately 20 to 40 dynes/cm.

Almost any type of substrate can be used to make the coated receiver used in this invention, including paper, film, and particularly transparent film, which is useful in making transparencies. The substrate must not melt, soften, or otherwise lose its mechanical integrity during transfer or fixing of the toner. A good substrate should not absorb the thermoplastic polymer, but should permit the thermoplastic polymer to stay on its surface and form a good bond to the surface. Substrates having smooth surfaces will, of course, result in a better image quality. A flexible substrate is particularly desirable, or even necessary, in many electrostatographic copy machines. A substrate is required in this invention because the thermoplastic coating must soften during transfer and fixing of the toner particles to the receiver, and without a substrate the thermoplastic coating would warp or otherwise distort, or form droplets, destroying the image.

Any good film-forming thermoplastic addition polymer can be used in the practice of the present invention to form a thermoplastic polymer coating on the substrate provided that it has a glass transition temperature or Tg which is less than approximately 10° C. above the Tg of the toner binder. As mentioned previously, the surface energy of the polymeric coating of the receiver material does not appear to be critical to the successful transfer of the toner particles from the element to the receiver as was true in the past where a higher surface energy element was utilized in the thermally assisted transfer method. Thus, thermoplastic addition polymers having surface energies as low as 10 dynes/cm or as high as 50 dynes/cm can be used as the receiver coating materials in the practice of the present invention.

The term "glass transition temperature" or "Tg" as used herein means the temperature or temperature range at which a polymer changes from a solid to a viscous liquid or rubbery state. This temperature (Tg) can be measured by differential thermal analysis as disclosed in Mott, N. F. and Davis, E. A. *Electronic Processes in Non-Crystalline Material*, Belfast, Oxford University Press, 1971. p. 192.

The term "surface energy" of a material as used herein means the energy needed or required to create a unit surface area of that material to an air interface. Surface energy can be measured by determining the contact angles of droplets of two dissimilar liquids, e.g., diiodomethane and distilled water. These measured angles are then used to calculate the total surface energy using the Girifalco and Good approximation. This method is described in detail in Fowkes, F. "Contact Angle, Wettability, and Adhesion" in: *Advances in*

*Chemistry Series* (Washington, D.C., American Chemical Society, 1964) p. 99–111.

A preferred weight average molecular weight for the thermoplastic addition polymer is about 20,000 to about 500,000. An especially preferred weight average molecular weight is about 50,000 to about 500,000. In general, lower molecular weight polymers may have poorer physical properties and may be brittle and crack, and higher molecular weight polymers may have poor flow characteristics and do not offer any significant additional benefits for the additional expense incurred. In addition to the foregoing requirements, the thermoplastic addition polymer must be sufficiently adherent to the substrate so that it will not peel off when the receiver is heated. It must also be sufficiently adherent to the toner so that transfer of the toner occurs. The thermoplastic polymer coating also should be abrasion resistant and flexible enough so that it will not crack when the receiver is bent. A good thermoplastic polymer should not shrink or expand very much, so that it does not warp the receiver or distort the image, and it is preferably transparent so that it does not detract from the clarity of the image.

The thermoplastic addition polymer advantageously should have a Tg that is less than approximately 10° C. above the Tg of the toner binder, which preferably has a Tg of about 50° to about 100° C., so that the toner particles can be pressed into the surface of the thermoplastic polymer coating during transfer thereby becoming slightly or partially embedded therein in contrast to being completely or nearly completely encapsulated in the thermoplastic polymer coating. Preferably, the Tg of the thermoplastic addition polymer is below the Tg of the toner binder, but polymers having a Tg up to approximately 10° C. above the Tg of the toner binder can be used at higher nip speeds when the toner is removed from the nip before it can melt. Melting of the toner in the nip should be avoided as it may cause the toner to adhere to the element or to damage the element. Since fixing of the toner on the receiver usually requires the fusing of the toner, fixing occurs at a higher temperature than transfer and fixing softens or melts both the toner and the thermoplastic polymer coating. A suitable Tg for the polymer is about 40° to about 80° C., and preferably about 45° to about 60° C., as polymers having a lower Tg may be too soft in warm weather and may clump or stick together, and polymers having a higher Tg may not soften enough to pick up all of the toner. Other desirable properties include thermal stability and resistance to air oxidation and discoloration.

Thermoplastic addition polymers which can be used in the practice of the present invention can be chosen from among polymers of acrylic and methacrylic acid, including poly(alkylacrylates), poly(alkylmethacrylates), and the like, wherein the alkyl moiety contains 1 to about 10 carbon atoms; styrene containing polymers, including blends thereof; and the like.

For example, such polymers can comprise a polymerized blend containing on a 100 weight percent combined weight basis, about 40 to about 85 weight percent of styrene and about 15 to about 60 weight percent of a lower alkyl acrylate or methacrylate having 1 to about 6 carbon atoms in the alkyl moiety, such as methyl, ethyl, isopropyl, butyl, and the like. Typical styrene-containing polymers prepared from such a copolymerized blend as above indicated are copolymers prepared from a monomeric blend which comprises on a 100 weight percent basis about 40 to about 80 weight percent styrene or styrene homolog, such as vinyl toluene, tert-butyl styrene, α-methylstyrene, and the like, a halogenated styrene such as p-chlorostyrene, an alkoxy-substituted styrene in which the alkoxy group contains from about 1 to 6 carbon atoms such as, for example, p-methoxy-styrene, and about 20 to about 60 weight percent of a lower alkyl acrylate or methacrylate. Especially preferred copolymers are polyvinyl(toluene-co-n-butyl acrylate), polyvinyl(toluene-co-isobutyl methacrylate), polyvinyl (styrene-co-n-butyl acrylate) polyvinyl (methacrylate-co-isobutyl methacrylate), poly (styrene-co-butyl acrylate-co-trimethylsilyloxyethyl methacrylate)—(65/34.5/0.5) and poly(styrene-co-butyl acrylate)—(65/35). A most preferred copolymer is polyvinyl(styrene-co-n-butyl acrylate).

Examples of such polymers which are presently available commercially include various styrene butylacrylates such as Pliotone 2003 and Pliotone 2015, both of which are available from Goodyear.

Other useful polymers include styrene butadiene copolymers, styrene isoprene copolymers and hydrogenated forms thereof.

The thermoplastic coating on the receiver can be formed in a variety of ways, including solvent coating, extruding, and spreading from a water latex. The resulting thermoplastic polymer coating on the substrate is preferably about 5 to about 30 micrometers in thickness, and more preferably about 2 to about 20 micrometers in thickness, as thinner layers may be insufficient to transfer all of the toner from the element and thicker layers are unnecessary and may result in warpage of the receiver, may tend to delaminate, may embrittle, or may result in a loss of image sharpness.

If desired, coating aids, such as polymethylphenylsiloxane having a methyl to phenyl ratio of 23:1 sold by Dow-Corning Company under the trade designation "DC 510", which is a surfactant, can be added to the thermoplastic polymer coating materials used in the practice of the present invention to facilitate a more uniform coating of the polymer onto the substrate. This can be done, for example, by dissolving both the thermoplastic addition polymer and the coating aid in a non-polar solvent, coating the polymer and coating aid containing solvent solution onto the surface of the substrate, and thereafter evaporating the solvent from the receiver, or by mixing the coating aid into a melt with the thermoplastic polymer and extruding the melt directly onto the surface of the substrate. Other materials which may be used as coating aids in the practice of the present invention, in addition to the aforedescribed surfactant, may include, for example, polysiloxanes, metal salts of organic fatty acids, and the like. If such a material is to be used as a coating aid in the practice of the present invention, it is dissolved in a non-polar solvent along with the thermoplastic polymer coating material in an amount such that the amount of the material present in the solution will be approximately 0.5% by weight of the combined weight of the thermoplastic polymer and the release agent, or less, and preferably from about 0.01 to about 0.05% by weight based on the combined weight of the thermoplastic polymer and the release agent. Likewise, if such a material is to be used as a coating aid in the practice of the present invention and is mixed into a melt with the thermoplastic addition polymer, the material will be present in the melt in an amount not exceeding approximately 0.5% by weight of the melt, and preferably from about 0.01 to about 0.05% by weight of the melt.

Alternatively, the coating aid material can be applied directly to a suitable substrate, such as paper, for example, as by melt extrusion, for example, prior to the formation or application of the thermoplastic polymer coating on the substrate, to form a coating or a layer of the material on the substrate between the substrate and the subsequently applied thermoplastic polymer layer. Coating materials such as polyethylene and polypropylene are examples of suitable materials which can be so applied to the surface of a substrate to facilitate a more uniform coating of the polymer on the receiver substrate. Such materials also serve as sealing layers for the substrate to impart a smooth surface to the substrate in addition to serving as a coating aid for the thermoplastic polymer. In general, the thickness of such a coating on the substrate may range from about 0.0001 to about 30 micrometers, and preferably from about 5 to about 30 micrometers.

Extrusion is the preferred method of forming the thermoplastic polymer coating on the receiver substrate. In general, extrusion conditions are determined by the thermal properties of the polymer such as melt viscosity and melting point. In the practice of this invention, one may extrude a molten layer comprised of a thermoplastic addition polymer as above characterized upon one face or surface of a receiver substrate of the type described above using suitable extrusion temperatures. If it is desired to apply a coating aid directly to the substrate prior to applying the thermoplastic polymer coating to the substrate, the coating aid can be melt extruded onto the substrate prior to extruding the thermoplastic polymer onto the substrate, or it can be coextruded with the polymer.

In the process of this invention, the receiver is preheated to a temperature such that the temperature of the receiver during transfer will be adequate to fuse the toner particles at their points of contact but will not be high enough to melt the toner particles, or to cause contacting toner particles to coalesce or flow together into a single mass. It is important also that the receiver be heated to a temperature such that the temperature of the thermoplastic polymer coating on the substrate is at least approximately 15° C. above the Tg of the thermoplastic polymer during transfer as it has been found that if the temperature of the thermoplastic polymer coating is not maintained at a temperature which is at least about 15° C. above the Tg of the thermoplastic polymer during transfer, less than 50%, and more typically less than 10%, of the toner particles will transfer from the element surface to the thermoplastic polymer coating during transfer. While it is imperative that the receiver be heated to a temperature such that the temperature of the thermoplastic polymer coating will be at least about 15° C. above the Tg of the thermoplastic polymer during transfer, caution must be exercised to make sure that the receiver is not heated to a temperature so high that the toner particles will melt and flow or blend together into a localized mass. In practice, it has generally been found to be prudent not to heat the receiver to a temperature whereby the temperature of the thermoplastic polymer coating during transfer exceeds a temperature which is approximately 25° C. above the Tg of the thermoplastic polymer. This is because the tendency of the thermoplastic polymer coating to adhere to the element surface increases as the temperature of the thermoplastic polymer coating rises above a level which is approximately 25° C. above the Tg of the polymer.

The temperature range necessary to achieve these conditions depends upon the time that the receiver resides in the nip and the heat capacity of the receiver. In most cases, if the temperature of the thermoplastic polymer coating immediately after it contacts the element is below the Tg of the toner binder, but above a temperature that is 20 degrees below that Tg, the toner particles will be fused or sintered at their points of contact and the temperature of the thermoplastic polymer coating will be at a temperature that is approximately at least about 15° C. above the Tg of the thermoplastic addition polymer. Or, stated another way, if the front surface of the thermoplastic polymer coating on the receiver substrate is preheated to a temperature such that the temperature of the thermoplastic polymer coating is from about 60° to 90° C. when it is in contact with the toner particles on the surface of the element during transfer, the temperature of the thermoplastic polymer coating will be at a temperature that is approximately at least 15° C. above the Tg of the thermoplastic polymer and the toner particles will be fused or sintered at their points of contact during transfer. However, receiver temperatures up to approximately 10° C. above the Tg of the toner binder are tolerable when nip time is small or the heat capacity of the receiver is low. Although either side of the receiver can be heated, it is preferable to conductively heat only the back surface of the receiver, i.e., the substrate surface or side of the receiver which does not contact the toner particles, such as by contacting the substrate with a hot shoe or a heated compression roller, as this is more energy efficient than heating the thermoplastic polymer coating surface of the receiver using a non-conductive source of heat such as, for example, a heat lamp or a plurality of heat lamps, or an oven which results in a less efficient absorption of the heat by the thermoplastic polymer coating. Furthermore, it is easier to control the temperature of that surface, and it usually avoids damage to the receiver. The preheating of the receiver must be accomplished before the heated thermoplastic polymer coating portion of the receiver contacts the element because the length of time during which the receiver is in the nip region when the toner particles are being contacted with the receiver and transferred to the thermoplastic polymer coating on the receiver substrate is so brief (i.e., typically less than 0.25 second, and usually 0.1 second or less), that it would be extremely difficult, if not impossible, to heat the receiver to the temperatures required for the successful transfer of the toner particles to the thermoplastic polymer coating if the receiver was heated only in the nip. Thus, if a backup roller, which presses the receiver against the element, is used to heat the receiver, the receiver must be wrapped around the backup roller sufficiently so that the receiver is heated to the proper temperature before it enters the nip. The backup or compression rollers which can be used in the practice of the process of the present invention to create an appropriate nip for acceptable toner transfer can be hard or compliant (i.e., resilient) rollers.

As with any thermally assisted method of transfer, it has been found that pressure aids in the transfer of the toner to the receiver, and an average nip pressure of about 135 to about 5000 kPa is preferred, as when a roller nip region is used to apply such pressures, or when such pressures are applied by a platen or equivalent. Lower pressures may result in less toner being transferred and higher pressures may damage the element and can cause slippage between the element and the receiver, thereby degrading the image.

As a result of the combination of contact time and temperature, and applied pressure, the toner particles are transferred from the element surface to the adjacent thermoplastic polymer coating surface on the receiver substrate. In all cases, the applied contacting pressure is exerted against the outside face or substrate side of the receiver opposite the thermoplastic polymer coated side or surface of the receiver and the side or face of the element opposite to the element surface on which the toner particles are carried.

Also, as mentioned previously. It is important that the temperature of the receiver be maintained at a temperature which is above the Tg of the thermoplastic polymer during separation of the receiver from the element immediately after the toner particles are transferred to the thermoplastic polymer coating on the receiver so that the receiver will separate from the element while hot without the thermoplastic polymer coating adhering to the element surface during separation.

In any case, the toner must not be fixed during transfer but must be fixed instead at a separate location that is not in contact with the element. In this way, the element is not exposed to high temperatures and the toner is not fused to the element. Also, the use of the lower temperatures during transfer means that the transfer process can be much faster, with 40 meters/minute or more being feasible.

Typically, after transfer of the toner particles from the element to the receiver and subsequent separation of the receiver from the element, the developed toner image is heated to a temperature sufficient to fuse it to the receiver. A present preference is to heat the image-bearing thermoplastic polymer coating surface on the receiver until it reaches or approaches its glass transition temperature and then place it in contact with a heated ferrotyping material which raises the temperature or maintains it above its glass transition temperature while a force is applied which urges the ferrotyping material toward the thermoplastic layer with sufficient pressure to completely or nearly completely embed the toner image in the heated layer. This serves to substantially reduce visible relief in the image and impart a smoothness to the coated layer on the receiver. The ferrotyping material, which conveniently can be in the form of a web or belt, and the receiver sheet can be pressed together by a pair of pressure rollers, at least one of which is heated, to provide substantial pressure in the nip. A pressure of at least approximately 690 kPa should be applied, however, better results are usually achieved with pressures of approximately 2100 kPa, typically in excess of about 6, 900 kPa, particularly with multilayer color toner images. The ferrotyping web or belt can be made of a number of materials including both metals and plastics. For example, a highly polished stainless steel belt, as electroformed nickel belts, and a chrome plated brass belt both have good ferrotyping and good release characteristics. In general, better results are obtained, however, with conventional polymeric support materials such as polyester, cellulose acetate and polypropylene webs, typically having a thickness of approximately 2–5 mils. Materials marketed under the trademarks Estar, Mylar and a polyamide film distributed by Dupont under the trademark Kapton-E, which optionally can be coated with a release agent to enhance separation, are especially useful ferrotyping materials. In addition, metal belts coated with heat resistant, low surface energy polymers, such as highly crosslinked polysiloxanes, also are effective ferrotyping materials. After the image-bearing thermoplastic coated surface has been contacted with the ferrotyping material and the toner image has been embedded in the heated thermoplastic coating or layer, the layer is allowed to cool to well below its glass transition temperature while it is still in contact with the ferrotyping material, After cooling, the layer is separated from the ferrotyping material.

Either halftone or continuous tone images can be transferred with equal facility using the process of this invention. Because the electrostatic image on the element is not significantly disturbed during transfer it is possible to make multiple copies from a single image-wise exposure.

Toners useful in the practice of this invention are dry toners having a particle size of less than 8 micrometers, and preferably 5 micrometers or less. The toners must contain a thermoplastic binder in order to be fusible.

The polymers useful as toner binders in the practice of the present invention can be used alone or in combination and include those polymers conventionally employed in electrostatic toners. Useful polymers generally have a Tg of from about 40° to 120° C., preferably from about 50° to 100° C. Preferably, toner particles prepared from these polymers have a relatively high caking temperature, for example, higher than about 60° C., so that the toner powders can be stored for relatively long periods of time at fairly high temperatures without having individual particles agglomerate and clump together. The melting point or temperature of useful polymers preferably is within the range of from about 65° C. to about 200° C. so that the toner particles can readily be fused to the receiver to form a permanent image. Especially preferred polymers are those having a melting point within the range of from about 65° to about 120° C.

Among the various polymers which can be employed in the toner particles of the present invention are polycarbonates, resin-modified maleic alkyd polymers, polyamides, phenol-formaldehyde polymers and various derivatives thereof, polyester condensates, modified alkyd polymers, aromatic polymers containing alternating methylene and aromatic units such as described in U.S. Pat. No. 3,809,554 and fusible crosslinked polymers and described in U.S. Reissue Pat. No. 31,072.

Typical useful toner polymers include certain polycarbonates such as those described in U.S. Pat. No. 3,694,359, which include polycarbonate materials containing an alkylidene diarylene moiety in a recurring unit and having from 1 to about 10 carbon atoms in the alkyl moiety. Other useful polymers having the above-described physical properties include polymeric esters of acrylic and methacrylic acid such as poly(alkyl acrylate), and poly(alkyl methacrylate) wherein the alkyl moiety can contain from 1 to about 10 carbon atoms. Additionally, other polyesters having the aforementioned physical properties also are useful. Among such other useful polyesters are copolyesters prepared from terephthalic acid (including substituted terephthalic acid), a bis(hydroxyalkoxy)phenylalkane having from 1 to 4 carbon atoms in the alkoxy radical and from 1 to 10 carbon atoms in the alkane moiety (which also can be a halogen-substituted alkane), and an alkylene glycol having from 1 to 4 carbon atoms in the alkylene moiety.

Other useful polymers are various styrene-containing polymers. Such polymers can comprise, e.g., a polymerized blend of from about 40 to about 100% by weight of styrene, from 0 to about 45% by weight of a lower alkyl acrylate or methacrylate having from 1 to about 4 carbon atoms in the alkyl moiety such as methyl, ethyl, isopropyl, butyl, etc. and from about 5 to about 50% by weight of another vinyl monomer other than styrene, for example, a higher alkyl acrylate or methacrylate having from about 6 to 20 or more carbon atoms in the alkyl group. Typical styrene-containing polymers prepared from a copolymerized blend as described hereinabove are copolymers prepared from a monomeric blend of 40 to 60% by weight styrene or styrene homolog, from about 20 to about 50% by weight of a lower alkyl acrylate or methacrylate and from about 5 to about 30% by weight of a higher alkyl acrylate or methacrylate such as ethylhexyl acrylate (e.g., styrene-butyl acrylate-ethylhexyl acrylate copolymer). Preferred fusible styrene copolymers are those which are covalently crosslinked with a small amount of a divinyl compound such as divinylbenzene. A variety of other useful styrene-containing toner materials are disclosed in U.S. Pat. Nos. 2,917,460; Re 25,316; 2,788,288; 2,638,416; 2,618,552 and 2,659,670. Especially preferred toner binders are polymers and copolymers of styrene or a derivative of styrene and an acrylate, preferably butylacrylate.

Useful toner particles can simply comprise the polymeric particles but it is often desirable to incorporate addenda in the toner such as waxes, colorants, release agents, charge control agents, and other toner addenda well known in the art. The toner particle also can incorporate carrier material so as to form what is sometimes referred to as a "single component developer." The toners can also contain magnetizable material, but such toners are not preferred because they are available in only a few colors and it is difficult to make such toners in the small particles sizes required in this invention.

If a colorless image is desired, it is not necessary to add colorant to the toner particles. However, more usually a visibly colored image is desired and suitable colorants selected from a wide variety of dyes and pigments such as disclosed for example, in U.S. Reissue Pat. No. 31,072 are used. A particularly useful colorant for toners to be used in black-and-white electrophotographic copying machines is carbon black. Colorants in the amount of about 1 to about 30 percent, by weight, based on the weight of the toner can be used. Often about 8 to 16 percent, by weight, of colorant is employed.

Charge control agents suitable for use in toners are disclosed for example in U.S. Pat. Nos. 3,893,935; 4,079,014; 4,323,634 and British Pat. Nos. 1,501,065 and 1,420,839. Charge control agents are generally employed in small quantities such as about 0.01 to about 3, weight percent, often 0.1 to 1.5 weight percent, based on the weight of the toner.

Toners used in this invention can be mixed with a carrier vehicle. The carrier vehicles, which can be used to form suitable developer compositions, can be selected from a variety of materials. Such materials include carrier core particles and core particles overcoated with a thin layer of film-forming resin. Examples of suitable resins are described in U.S. Pat. Nos. 3,547,822; 3,632,512; 3,795,618; 3,898,170; 4,545,060; 4,478,925; 4,076,857; and 3,970,571.

The carrier core particles can comprise conductive, non-conductive, magnetic, or non-magnetic materials, examples of which are disclosed in U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See for example, U.S. Pat. Nos. 4,042,518; 4,478,925; and 4,546,060.

The very small toner particles that are required in this invention can be prepared by a variety of processes well-known to those skilled in the art including spray-drying, grinding, and suspension polymerization.

As indicated above, the process of this invention is applicable to the formation of color copies. If a color copy is to be made, successive latent electrostatic images are formed on the element, each representing a different color, and each image is developed with a toner of a different color and is transferred to a receiver. Typically, but not necessarily, the images will correspond to each of the three primary colors, and black as a fourth color if desired. After each image has been transferred to the receiver, it can be fixed on the receiver, although it is preferable to fix all of the transferred images together in a single step. For example, light reflected from a color photograph to be copied can be passed through a filter before impinging on a charged photoconductor so that the latent electrostatic image on the photoconductor corresponds to the presence of yellow in the photograph. That latent image can be developed with a yellow toner and the developed image can be transferred to a receiver. Light reflected from the photograph can then be passed through another filter to form a latent electrostatic image on the photoconductor which corresponds to the presence of magenta in the photograph, and that latent image can then be developed with a magenta toner which can be transferred to the same receiver. The process can be repeated for cyan (and black, if desired) and then all of the toners on the receiver can be fixed in a single step.

The image-bearing element from which the toner particles are transferred upon contact with the thermoplastic polymer coated receiver sheet of the invention can include any of the electrostatographic elements well known in the art, including electrophotographic or dielectric elements such as dielectric recording elements, and the like with the proviso that the toner contacting surface layer of the element, i.e., the surface layer of the element on which the toner particles are carried is a film-forming, electrically insulating thermoplastic polymeric binder resin matrix which comprises a crystalline side chain polyester or a block copolyester or copolycarbonate having a crystalline side chain polyester block and has a surface energy of not greater than approximately 40 dynes/cm, preferably from approximately 20 to 40 dynes/cm.

The use of such an element has been found to be essential to the practice of the present process in order to achieve virtually 100 percent transfer of the very small toner particles while at the same time preventing the thermoplastic polymer: coated receiver from adhering to the element during transfer and subsequent separation of the receiver from the element without resorting to the use of a release agent coated on or otherwise applied to the thermoplastic polymer coating on the receiver substrate, prior to toner contact and toner transfer and further to increase the range of temperatures between the onset of acceptable transfer and the onset of sticking of the image-bearing element to the receiver.

The image-bearing element can be in the form of a drum, a belt, a sheet or other shape and can be a single use material or a reusable element. Reusable elements are preferred because they are generally less expensive. Of course, reusable elements must be thermally stable at the temperature of transfer.

A present preference is to employ a photoconductive element for the element used in toner particle or toner image transfer. The photoconductive element is preferably conventional in structure, function and operation, such as is used, for example, in a conventional electrophotographic copying apparatus. The element is conventionally imaged. For example, an electrostatic latent image-charge pattern is formed on the photoconductive element which can consist of one or more photoconductive layers deposited on a conductive support, such as, for example, a nickel-coated poly(ethylene terephthalate) film. By treating the charge pattern with, or applying thereto, a dry developer containing charged toner particles, the latent image is developed. The toner pattern is then transferred to a receiver in accordance with the practice of the present invention and subsequently fused or fixed to the receiver.

Various types of photoconductive elements are known for use in electrophotographic imaging processes. In many conventional elements, the active photoconductive components are contained in a single layer composition. This composition is typically affixed, for example, to a conductive support during the electrophotographic imaging process.

Among the many different kinds of photoconductive compositions which may be employed in the typical single active layer photoconductive elements are inorganic photoconductive materials such as vacuum evaporated selenium, particulate zinc oxide dispersed in a polymeric binder, homogeneous organic photoconductive compositions composed of an organic photoconductor solubilized in a polymeric binder, and the like.

Other useful photoconductive insulating compositions which may be employed in a single active layer photoconductive element are the high-speed heterogeneous or aggregate photoconductive compositions described in U.S. Pat. No. 3,732,180. These aggregate-containing photoconductive compositions have a continuous electrically insulating polymer phase containing a finely-divided, particulate, co-crystalline complex of (i) at least one pyrylium-type dye salt and (ii) at least one polymer having an alkylidene diarylene group in a recurring unit.

In addition to the various single active layer photoconductive insulating elements such as those described above, various "multi-layer" photoconductive insulating elements have been described in the art. These kinds of elements, also referred to as "multi-active", or "multi-active-layer" photoconductive elements, have separate charge generation and charge transport layers as are appreciated by those familiar with the art. The configuration and principles of operation of multi-active photoconductive elements are known as are methods for their preparation having been described in a number of patents, for example, in U.S. Pat. Nos. 4,175,960; 4,111,693; and 4,578,334. Another configuration suitable for the imaging of elements in the practice of the process of the invention is the "inverted multi-layer" form in which a charge-transport layer is coated on the conductive substrate and a charge-generation layer is the surface layer. Examples of inverted multi-layer elements are disclosed, for example, in U.S. Pat. No. 4,175,960.

It should be understood that, in addition to the principal layers which have been discussed, i.e., the conductive substrate and the charge-generation and the charge-transport layers, the photoconductive elements which can be used in the practice of the present invention may also contain other layers of known utility, such as subbing layers to improve adhesion of contiguous layers and barrier layers to serve as an electrical barrier layer between the conductive layer and the photoconductive composition. Apart from the polymers or other addenda which are used to impart the desired low surface energy to the electrophotographic imaging element, the balance of the composition of the charge-generation and charge-transport layers may also comprise any of the materials known to be effective in such layers including addenda such as leveling agents, surfactants and plasticizers to enhance various physical properties. For example, the charge generation layer may comprise a pigment or other photoconductive material, either as the sole component of the charge generation layer, or as a dispersion or solid solution in a polymeric binder. This pigment or photoconductive material may be sensitive to any of the useful imaging radiations, e.g., ultraviolet, visible or infrared. For digit imaging exposure, near-infrared sensitivity, between about 700 and 900 nm, is preferred. For this purpose, the phthalocyanine family of pigments has been found to exhibit acceptable sensitivity and photoconductivity. Especially preferred is a dispersion of titanyl tetrafluorophthalocyanine in a polymeric binder. Generally useful concentrations of this pigment are in the range of 1–99 weight percent of the dried charge generation layer. For an inverse composite structure, suitable pigment concentrations are in the range of 1–10 weight percent, preferably 1–6 weight percent. Although there are many suitable polymeric binders which have been found to be useful for charge generation layers of electrophotographic elements, a particularly preferred polymeric binder for the charge generation layer is the copolyester of terephthalic acid, azelaic acid, and 4,4'-2-(norbornylidiene)bisphenol, in a molar ratio of about 30/20/50. A suitable amount of polymeric binder present in the charge generation layer is in the range of about 1–99 weight percent, preferably 90–99 weight percent, of the dried charge generation layer. In addition to pigment and polymeric binder, there may be other addenda present in the charge generation layer to enhance performance of physical properties, such as adhesion, uniformity, or thermal stability. For the preferred inverse composite structure, a suitable thickness of the charge generation layer is in the range of 0.5–10 micrometers, preferably 4–8 micrometers.

With respect to the charge transport layer, there are many known classes of charge-transporting compounds and materials, including those which transport electrons, holes, or both electrons and holes. These compounds are most desirably incorporated as a solid solution in a polymeric binder. In the context of an inverse composite structure and the preferred charge generation layer described above, a homogeneous mixture of one or more hole-transport materials in a polymeric binder is preferred. Especially preferred is a mixture of tri-4-tolylamine, 1,1-bis-[4-(di-4-tolylamino)phenyl]cyclohexane, and diphenylbis-(4-diethylaminophenyl)methane, in a ratio of 19/19/2 by weight. An alternate preferred hole-transport material is 3,3'-bis-[4-di-4-tolylamino)phenyl]-1-phenylpropane. A suitable concentration of the hole-transport material or mixture of materials is in the range of 10–60 weight percent, preferably 30–50 weight percent, of the dried charge transport layer. A preferred polymeric binder for the charge transport layer is bisphenol-A polycarbonate, obtained under the tradename Makrolon, available from the Mobay Chemical Company. The preferred concentration of the binder ranges from 50–70 weight percent of the dried charge transfer layer. In addition to the charge-transport materials and polymeric binder, there may be other addenda present in the charge transport layer to enhance performance of physical properties, such as adhesion, uniformity, or thermal stability. A suitable thickness of the charge transport layer is in the range of 5–30 microns, preferably 10–20 microns, for an inverse composite structure.

In addition, addenda such as contrast control agents to modify the electrophotographic response of the element can be incorporated in the charge-transport layers.

In all instances, however, it is essential that the surface layer of the electrostatographic element of choice contain an electrically insulating thermoplastic polymeric binder resin matrix which comprises a polymer containing polyester repeating units which have crystalline side chains and have a surface energy of not more than approximately 40 dynes/cm, and preferably from approximately 20 to 40 dynes/cm. Preferably, the polymer is a block copolyester of a copolycarbonate containing crystalline side chain polyester block. By "crystalline side chain polyester repeating units" is meant that the polyester repeating units have side chains, such as $C_{18}$ alkyl and the like, which are crystalline. As indicated above, the surface energy of the element surface can be readily and easily determined or measured by one skilled in the art using the contact angle procedure disclosed in the aforementioned Fowkes, F. "Contact Angle, Wettability, and Adhesion." in: *Advances in Chemical Series* (Washington, D.C., American Chemical Society, 1964) p. 99–111.

The binder resin matrix for the surface layer comprises a polymer of the type referred above, i.e., a polymer containing a polyester repeating unit having crystalline side chains. Advantageously, this polymer is a block copolyester or copolycarbonate having a polyester block with crystalline side chains. Also, advantageously, the block copolymer is the sole binder resin of the surface layer. Alternatively, however, the block copolymer can be blended as an additive with other polyester or polycarbonate binder resins. Also, alternatively, a crystalline side chain polyester of the kind used to prepare the block polyester can be used as an additive with such other polyester or polycarbonate binder resins. In any event, the amount of such block copolymer or polyester in the binder resin matrix, is sufficient to provide from about 5 to 50 weight percent of crystalline side chain polyester repeating units in the binder resin matrix.

The polyesters which are used as an additive for the binder resin matrix or as an oligomeric precursor for the block copolyester or copolycarbonate having repeating units of the general formula:

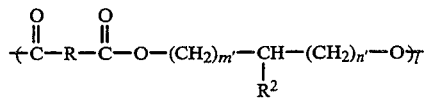

wherein

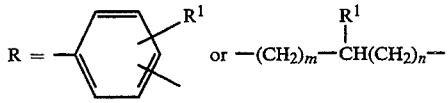

wherein m, n, m' and n' are zero or positive integers, m+n=0 to 3, m'+n'=1 to 5, $R^1$ and $R^2$ are crystalline aliphatic hydrocarbon side chain groups or hydrogen, with the proviso that no more than one of such groups is hydrogen, and 1 is an integer from 1 to 10. These repeating units have appropriate endcapping groups. When used as precursors for block copolymer, the endcapping groups are functional groups for condensation reactions, such as —OH, —COOH, or —COHal (Hal being halogen, preferably Cl or Br).

The block copolyesters or copolycarbonates can be made by copolymerizing binder resin polyester or polycarbonate monomers with a crystalline side chain polyester which is endcapped with functional groups for condensation reactions and the repeating units of which have crystalline side chains.

The crystalline aliphatic hydrocarbon groups $R^1$ and $R^2$ can be either straight or branched chain, alkyl or olefinic groups, so long as the substituent is crystalline. Preferred are alkyl groups of from 12 to 20 carbon atoms, e.g., n-dodecyl, n-hexadecyl, n-octadecyl and 2-ethyloctadecyl. Especially preferred are long straight chain alkyl groups of up to 20 carbon atoms. Although, the molecular weight of the polyester can vary over a considerable range, the preferred polyesters as precursors for the block copolymers are of molecular weight, e.g., Mn=2000 to 12,000. If used as additives (i.e., not as repeating units of a block copolymer), they are preferably of molecular weight, e.g., Mn=4,000 to 15,000.

An important advantage of the binder resin compositions used in the present invention is that they are soluble in commonly used volatile coating solvents such as dichloromethane and tetrahydrofuran. Dichloromethane is a preferred coating solvent because of its low boiling point, high vapor pressure and non-flammability. The components of the photoconductive layers, e.g., binder resins, pigments, charge transport materials, charge generation materials and the crystalline side chain polyester, if used as an additive, are dissolved or dispersed in the coating solvent, then coated on the appropriate substrate and the volatile solvent is evaporated. The polyesters or block copolymers containing the crystalline (or crystallizable) side chains dissolve in coating solvents such as dichloromethane, as do the usual amorphous binder resin components, and when the solvent is evaporated the hydrocarbon side chains form crystalline domains in the amorphous matrix or continuous phase of the surface layer of the photoconductive element.

Regarding the solubility of the crystalline side chain polyester in coating solvents, the chain length and, hence, the melting point (Tm) of the crystalline or crystallizable repeating units is significant. The Tm of these crystalline blocks can be as low as just above room temperature, e.g., as low as about 30° C. When the side chains are octadecyl groups, the Tm is around 61° C. and this is satisfactory. However, if the side chains are too long, the polyester and block copolymer will not be soluble in the more desirable volatile solvents. For instance, an ethylene glycol/substituted succinic anhydride polyester having $C_{30}$ alkyl side chains and a Tm of 70° C. and the crystalline polyester repeating units were not soluble in dichloromethane. The polyester, therefore, could not be satisfactorily coated with that particular solvent.

As already mentioned, the copolymers and polyesters having crystalline side chains are compatible with phthalocyanine photoconductive pigments. By this is meant that when dispersed in binder resin matrix comprising such crystalline side chain polymers, the phthalocyanine pigments do not agglomerate as they do in some binder resins which are otherwise satisfactory because of good toner release properties. As a result, finely divided phthalocyanine pigment particles such as disclosed in the patent to Hung, et al, U.S. Pat. No. 4,701,396, can be used to full advantage with toners of small particle size to form images of very high resolution.

In addition, they are compatible with the formation of aggregate high-speed organic photoconductors within the binder matrix.

The crystalline side chain polyesters, whether to be used as an additive in the binder resin matrix or as a precursor for a block copolyester or copolycarbonate, can be made by known polyesterification methods, including either bulk or solution polymerization. The selected diol and dicarboxylic acid (or its polyesterification equivalent) are reacted in approximately equal molar proportions. The crystalline side chain such as a long alkyl side chain is present either in the diol or the diacid or in both. Examples of useful reactants for synthesizing the polyester include, as diacids, 2-n-octadecylsuccinic acid, phthalic acid, isophthalic acid, terephthalic acid and 2-octadecylterephthalic acid, and as diols, ethylene glycol, 1,3-propane diol, 1,4-butane diol, neopentyl glycol, 2-dodecyl-1,3-propane diol, 2-octadecyl-1,4-butanediol and 1,10-decanediol.

Following are examples of crystalline side chain polyester repeating units, which can, with appropriate endcapping, be polyester additives or can be repeating units of block copolyester or copolycarbonates:

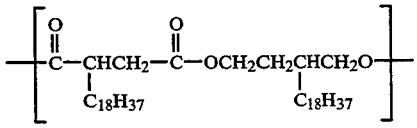

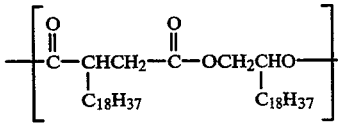

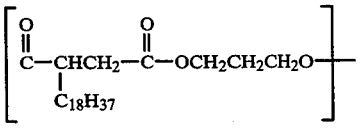

-continued

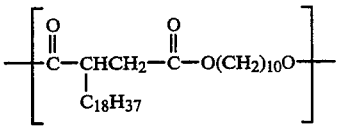

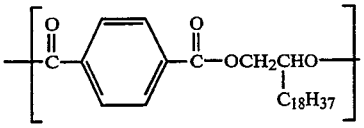

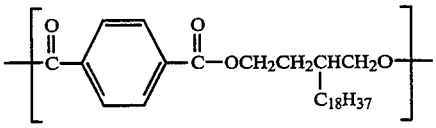

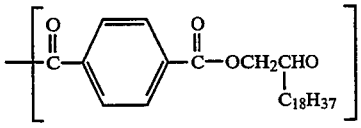

The block copolymer contains a block or blocks derived from the crystalline side chain polyester and the polyester or polycarbonate binder resin segments derived from the monomeric diacids and diols. The latter can be selected from a range of amorphous polymer types that are suitable as binder resins for photoconductive elements surface layers. Suitable types include poly(bisphenol-A carbonate), poly(tetramethylcyclobutylene carbonate), and poly(arylene-) or poly(alkylene phthalates) such as poly(ethylene terephthalate), poly(-tetramethylene terephthalate), poly(tetramethylene isophthalate), poly(tetramethyleneglyceryl terephthalate), poly(hexamethylene terephthalate), poly(1,4-dimethylolcyclohexane terephthalate), poly(p-benzenediethyl terephthalate), poly(bisphenol-A terephthalate), poly(4,4'-(2-norbornylidene) bisphenol-A terephthalate), poly(4,4'-(hexahydro-4,7-methanoindan-5-ylidene)diphenol terephthalate) or isophthalate, poly(tetramethylene-2,6-naphthalene dicarboxylate), poly(xylylene-2,6 naphthalene dicarboxylate), poly(ethylene adipate), and poly[ethylenebis(4-carboxyphenoxyethane)].

Preferably, the binder resin segment of the copolymer is a complex polyester formed from one or more diacids (by which term we mean to include the esterification equivalents such as acid halides and esters), and one or more diols, e.g., from dimethyl terephthalate, 2,2-norbornanediylbis-4-phenoxyethanol and 1,2-ethanediol or from a terephthaloyl halide, an azelaoyl halide and 4,4'-(2-norbornylidene)bisphenol. Other useful binder resin polyesters include those disclosed, e.g., in U.S. Pat. No. 4,284,699 to Berwick et al.

In preparing the block copolymer, the polymerization reaction of the oligomer and the polyester or polycarbonate monomers can be carried out by known techniques such as bulk polymerization or solution polymerization. To achieve optimum results, a crystalline side chain polyester oligomer having a molecular weight (Mn) from about 500 to 15,000 and, preferably, 2,000 to 12,000, should be used as a precursor for the block copolymer. The amount of oligomer employed in the reaction should be sufficient to provide the desired surface properties but not so much as to reduce the physical strength of the ultimate binder matrix excessively. The exact amount will depend on the desired balance of these properties and also on whether the block copolymer is the sole binder in the binder matrix or is blended as an additive with another binder resin. Preferably, however, the amount of the polyester oligomer employed should be sufficient to provide from about 5 to 50 weight percent of the resulting block copolymer and most preferably from about 10 to 30 weight percent.

If the polyester is to be used as such as an additive for the binder resin matrix it can be synthesized in the same way and with the same reactants as are used for making the polyester oligomer precursor for the block copolyester. However, when used as an additive, the polyester preferably is of higher molecular weight than the oligomer, e.g., having a number average molecular weight up to about 25,000 and preferably from 4,000 to 15,000.

In the block copolymers used in accordance with the present invention, the polyester or polycarbonate segments form an amorphous continuous phase which give the needed physical strength, and the blocks having crystalline side chains form a discontinuous phase and provide the desired surface properties. These results can be obtained when using the block copolymer as the sole binder resin in the surface layer or when using it or the crystalline side chain polyester oligomer as an additive with one or more other binder resins.

A particularly preferred copolymer for use in the practice of the present invention to be used either as the binder resin for the surface layer of the image-forming element or as an additive for other binder resins to make up the surface layer of the image-bearing element is poly(4,4'-(2-norbornylidene)bisphenol terephthalate-co-azelate)-block-poly-(ethylene 2-n-octadecylsuccinate).

When used for electrophotographic imaging, the surface layer of the element is charged in the dark to a suitable voltage, e.g., a negative voltage of 600 volts. The charged element is exposed imagewise to a pattern of actinic radiation such as visible light, causing charges in the exposed areas of the surface layer to dissipate. The surface is then contacted with finely divided particles of a charged dry toner such as pigmented thermoplastic resin particles to develop the electrostatic-charge latent image. The toner image is then transferred to a thermoplastic coated receiver sheet of the type employed herein in accordance with the practice of the present invention and subsequently fixed by heat, pressure or other means.

A presently preferred photoconductive element is a near infrared sensitive inverted multi-layer photoconductive element made from fluorine-substituted titanyl tetrafluorophthalocyanine pigments which is disclosed in U.S. Pat. No. 4,701,396.

The invention is further illustrated by the following examples which describe the preparation of block copolymers and of photoconductive films containing such copolymers. The first example describes the synthesis of a polyester oligomer which is useful either as an additive for the binder resin matrix or as a precursor for block copolyesters or block copolycarbonates to be used as binder resins or as additives for binder resins.

EXAMPLE 1

Preparation of Poly(Ethylene 2-n-Octadecylsuccinate)

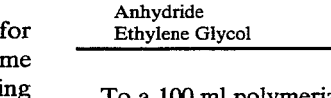

| Compound | Amount | Mols | Mw |
|---|---|---|---|
| 2-n-Octadecylsuccinic Anhydride | 70.4 g | 0.20 | 35 |
| Ethylene Glycol | 20 g | 0.32 | 62 |

To a 100 ml polymerization flask was charged 70.4 g (0.20 mole) 2-n-octadecylsuccinic anhydride, 20 g (0.32 mole) ethylene glycol and 2 drops of tetraisopropyl titanate. The contents of the flask were heated under nitrogen to 220° C. and a reflux head attached. The solution was heated at 220° C. for two hours followed by one hour at 240° C. after removal of the reflux head. The flask was then attached to vacuum, 500μ, and contents polymerized at 240° C. for eight hours.

Yield: 76 g., Inherent Viscosity 0.30 dL/g (Dichloromethane 25° C., 0.25% Solids), $T_M$=59° C. Hydroxyl group titration, 0.187 meq/g; Mn=10,700 amu.

The next example describes the use of a polyester oligomer as produced in Example 1 to synthesize a block copolyester which is useful as a binder resin or as an additive in the binder resin matrix.

EXAMPLE 2

Preparation of Poly(4,4'-(2-norbornylidene)bisphenol terephthalate-co-azelate)-block-poly-(ethylene 2-n-octadecylsuccinate)

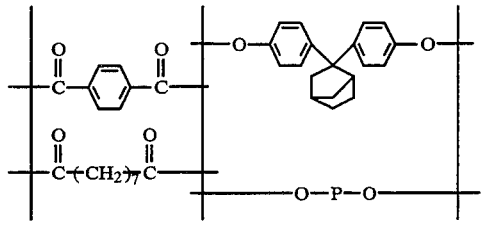

| Compound | Amount | Mols | MW |
|---|---|---|---|
| Terephthaloyl chloride | 22.3 g | 0.110 | 203 |
| Azelaoyl chloride | 18.0 g | 0.080 | 225 |
| 4,4(2-Norbornylidene)-bisphenol | 56.0 g | 0.200 | 280 |
| Triethylamine | 50.9 g | 0.504 | 101 |
| Poly(ethylene 2-n-octadecylsuccinate) α, ω-hydroxyl terminated | 29.5 g | — | 10,000 |

To a two liter, three-necked, round-bottom flask equipped with a mechanical stirrer, addition funnel, and nitrogen inlet, there was charged a solution of 56.0 g (0.200 mole) 4,4'-(2-norbonylidene)bisphenol, 29.5 g of α,ω-hydroxyl terminated poly(ethylene 2-n-octadecylsuccinate), 70 mL of triethylamine and 398 mL of dichloromethane. A solution of 22.3 g (0.110 mole) of terephthaloyl chloride and 18.0 g (0.080 mole) of azelaoyl chloride in 200 mL of dichloromethane was added dropwise with stirring. Intermittent cooling with an ice water bath was used to control the exotherm. An additional 4 g of terephthaloyl chloride in 100 mL of dichloromethane was subsequently added. The reaction mixture became very thick, and additional dichloromethane was added to reduce the viscosity. The reaction mixture was transferred to a separatory funnel and was washed with dilute hydrochloric acid, followed by several water washes, until the polymer dope (organic phase) washings were neutral. The block copolymer was isolated by precipitation into methanol (1/3 vol/vol; polymer dope/methanol) collected and dried in vacuo at 60° C. Yield: 100 g. GPC: Mn=79,800; Inherent Viscosity 0.79 L/g (DCM 25° C.).

The next example describes the preparation and testing of photoconductive films of the invention and of control films outside the scope of the invention.

EXAMPLE 3

Four multilayer photoconductive films, designated as Films A, B, C, and D, were prepared. For each, the support or base was a nickelized poly(ethylene terephthalate) film. On each support was coated a charge transport layer (CTL) on which was coated a charge generation layer (CGL), which, in each case, was the surface layer of the film. Compositions of the different layers of the four films were as follows (parts are by weight)

Film A (Control 1)

CGL: 6.5 g/m$^2$ dry coverage
Binder:
67.5 parts of poly[4,4'-(2-norbornylidene)bisphenol terephthalate-co-azelate—(60/40)]
Photoconductors:
25 parts 4-dicyanomethylene-2-phenyl-6-(4-tolyl)-4H-thiopyran 1,1-dioxide;
5 parts tri-4-tolylamine
Pigments:
1.5 parts titanyl tetra-4-fluorophthalocyanine;
1.0 part titanyl phthalocyanine
CTL: 15 g/m$^2$ dry coverage
Binders:
57.5 parts bisphenol-A polycarbonate (Makrolon, from Mobay Chemical Company);
2.5 parts poly[ethylene terephthalate-co-neopentyl terephthalate—(55/45)]
Charge Transport Compounds:
19 parts tri-4-tolylamine;
19 parts 1,1-bis-[4-(di-4-tolylamino)phenyl]cyclohexane;
2 parts diphenylbis-(4-diethylaminophenyl)methane

Film B (Control 2)

CGL: 6.5 g/m$^2$ dry coverage
Binder:
68 parts poly[4,4'-(2-norbornylidene)bisphenol terephthalate-co-azelate—(40/60)]
Photoconductors:
25 parts 4-dicyanomethylene-2-phenyl-6-(4-tolyl)-4H-thiopryan-1,1-dioxide;
5 parts tri-4-tolylamine
Pigments:
1.2 parts titanyl tetra-4-fluorophthalocyanine;
0.8 parts titanyl phthalocyanine
CTL: 15 g/m$^2$ dry coverage
Binder:
57.5 parts bisphenol-A-polycarbonate (Makrolon, from Mobay Chemical Company);
2.5 parts poly[ethylene terephthalate-co-neopentyl terephthalate—(55/45)]
Charge Transport Compound:
40 parts 3,3'-bis-[4-(di-4-tolylamino)phenyl]-1-phenyl-propane

Film C (Control 3)

Same as Film A, except that: (a) the entire CGL binder is replaced with 67 parts of a polycarbonate comprising equal amounts of bisphenol-A and hexafluorobisphenol-A, (b) the ratio of the two photoconductors in the CGL is 15/15 instead of 25/5, and (c) the ratio of the two pigments in the CGL is 1.8/1.2 instead of 1.5/1.0.

Film D

Same as Film A, except that the entire CGL binder is replaced with the crystalline side chain polyester of synthesis Example 2.

Surface Energy Measurements

The surface energies of films A, B, C, and D were measured as follows. For each sample, drops of water and diiodomethane were placed on the surface of the film, and the contact angles between the drops and the films surface were measured with a goniometer. At least three measurements were made with each fluid on each sample. The measured contact angles were averaged, and the average angles were used to calculate the total surface energies using the Good-Girifalco approximation. These energies are summarized as follows:

| FILM | SURFACE ENERGY (dyn/cm) |
|---|---|
| A | 50 |
| B | 50 |
| C | 43 |
| D | 37 |

The results show that when the crystalline side chain polyester of Example 2 comprised the entire CGL of an inverse composite film structure, there was a marked lowering of the surface energy of the film when compared to the control films.

Sensitometric Tests

Films A, B, C, and D were tested for both photodecay and dark decay. The photodecay was measured with an exposure of about 2 erg/cm$^2$-sec at 830 nm on a sample of film which had been charged to +500 V. The amount of exposure required to discharge the film to +100 V is used to compare the photodecays of the different films. The dark decay was measured by first heating the film sample to 40° C., charging to about +600 V, then measuring the amount of charge which is dissipated in the dark for 30 sec. The dark decay is expressed as the rate of charge decay in volts/sec over the 30 sec period. The photodecay and dark decay results are given in the following table.

| FILM | PHOTODECAY (erg/cm$^2$) | DARK DECAY (V/sec) |
|---|---|---|
| A | 6.7 | 10.6 |
| B | 7.7 | 8.6 |
| C | 7.6 | 7.1 |
| D | 7.0 | 12.1 |

The results show that when the crystalline side chain polyester prepared as described in Example 2 comprised the enter CGL of an inverse composite film structure (Film D), as well as when the fluorine-containing polycarbonate binder was added to the GCL of an inverse composite film structure (Film C), there was no significant adverse effect on either the photodecay or the dark decay when compared to the control Films A and B.

Off-line Sticking Tests

The propensity of films A, C, and D to stick to various thermoplastic receivers was evaluated in the following manner. Each film and receiver combination was wrapped around a pair of heated rollers, and the rollers were brought into contact with one another such that a nip was formed between the film and receiver. The nip pressure was held constant at a value of 15 pli, while the temperature was systematically varied in increments of 3° C., from 54° to 84° C. At each temperature, the film and receiver were separated. Sticking was qualitatively evaluated by the following scale:

| OBSERVATION | RATING | JUDGEMENT |
|---|---|---|
| easily separated, no noise/ light noise | 1–4 | acceptable |
| easily separated, medium noise | 5–7 | unacceptable |
| light-heavy sticking, heavy noise | 7–10 | unacceptable |
| blistering, thermoplastic separation | 10+ | unacceptable |

The temperature at which the sticking was first judged unacceptable by the preceding criteria was used to compare the various film/receiver combinations. In general, the higher the temperature before sticking is judged unacceptable, the better.

The following thermoplastic receivers were evaluated:

X=a 10 micron coating of poly(styrene-co-butyl acrylate-co-trimethylsilyloxyethyl methacrylate)—(65/34.5/0.5) (Tg=47° C.) on a substrate of polyethylene coated flexible paper; total surface energy =31 dynes/cm outside the range of the surface energies of the receivers described in U.S. Pat. No. 5,043,242).

Y=a 10 micron coating of poly(styrene-co-butyl acrylate)—(65/35) (Tg=44° C.) on a substrate of polyethylene coated flexible paper; total surface energy =39 dynes/cm (within the range of surface energies of the receivers described in U.S. Pat. No. 5,043,242).

The following table gives the temperature at which the onset of unacceptable sticking occurs for each of the film-receiver combinations:

| | THERMOPLASTIC RECEIVER COATINGS | |
|---|---|---|
| FILMS (surface energies) | X (31 dynes/cm) | Y (39 dynes/cm) |
| A (50 dynes/cm) (control) | 63° C. | 60° C. |
| C (43 dynes/cm) (control) | 63° C. | 63° C. |
| D (37 dynes/cm) | 69° C. | 69° C. |

These results show that there is a clear trend toward higher temperatures at which the onset of sticking occurs when the surface energy of the film is less than about 40 dynes/cm. Further, Control Film C, which exhibits a surface energy in the preferred range of the surface energies of the films described in U.S. Pat. No. 5,043,242, shows very little improvement in the onset of sticking when compared to Control Film A, even when tested against receiver Y, which exhibits a surface energy in the range of the surface energies of the receivers described in U.S. Pat. No. 5,043,242. It should also be noted that Film D, which exhibits a surface energy outside the preferred range of the surface energies of the films described in U.S. Pat. No. 5,043,242, yielded a substantial improvement in the onset of sticking, even when tested against receiver X, which also exhibited a surface energy outside the range of surface energies of the receivers described in U.S. Pat. No. 5,043,242. In summary, the highest temperatures at which unacceptable sticking are first observed occurs for combinations of film and receiver which display surface energies which are outside the preferred ranges as specified in U.S. Pat. No. 5,043,242.

Although the examples have described specific photoconductive layer compositions, it should be understood that the photoconductive elements used in the invention can employ a wide range of photoconductors and other components. The heterogeneous or aggregate photoconductors of the types disclosed in the patent to Light, U.S. Pat. No. 3,615,414, the patent to Gramza et al., U.S. Pat. No. 3,732,180; and the patent to Fox et al., U.S. Pat 3,706,554 are useful for the charge generating layer. Other photoconductors are also suitable, including the organic photoconductors of Rossi, U.S. Pat. No. 3,767,393; Fox, U.S. Pat. No. 3,820,989; and Rule, U.S. Pat. No. 4,127,412; the various photoconductive materials described in Research Disclosure, No. 10938, published May 1973, pages 62 and 63; and especially the phthalocyanine photoconductive pigments of Borsenberger et al, U.S. Pat. No. 4,471,039.

Binders in the charge generation and charge transport layers of the imaging elements used in the invention, including the block copolymers employed in the surface layer, are film forming polymers having a fairly high dielectric strength and good electrical insulating properties. Examples of suitable binder resins for layers other than the surface layer include butadiene copolymers; polyvinyl toluene-styrene copolymers; styrene-alkyd resins; silicone-alkyd resins; soya-alkyd resins; vinylidene chloride-vinyl chloride copolymers; poly(vinylidene chloride); vinylidene chloride-acrylonitrile copolymers; vinyl acetatevinyl chloride copolymers; poly(vinyl acetals) such as poly(vinyl butyral); nitrated polystyrene; polymethylstyrene; isobutylene polymers; polyesters such as poly[ethylene-co-alkylenebis-(alkyleneoxyaryl)phenylenedicarboxylate]; phenol formaldehyde resins; ketone resins; polyamides; polycarbonates; poly[ethylene-co-isopropylidene-2,2-bis(ethyleneoxyphenylene)terephthalate]; copolymers of vinyl haloacrylates and vinyl acetate such as poly(vinyl-m-bromobenzoate-co-vinyl acetate); chlorinated poly(olefins) such as chlorinated poly(ethylene); etc.

Polymers containing aromatic or heterocyclic groups are most effective as binder because they provide little or not interference with the transport of charge carriers through the layer. Polymers containing heterocyclic or aromatic groups which are especially useful in p-type charge transport layers include styrene-containing polymers, bisphenol-A polycarbonates, polymers, phenol formaldehyde resins, polyesters such as poly[ethylene-co-isopropylidene-2,2-bis-(ethyleneoxyphenylene)]-terephthalate and copolymers of vinyl haloacrylates and vinyl acetate.

Especially useful binders for either the charge generation or charge transport layers are polyester resins and polycarbonate resins such as disclosed in the patents to Merrill U. S. Pat. Nos. 3,703,372; 3,703,371 and 3,615,406, the patent to Berwick et al U.S. Pat. No. 4,284,699 and the patent to Gramza et al, U.S. Pat. No. 3,684,502 and Rule et al, U.S. Pat. No. 4,127,412. Such polymers can be used in the surface layer in admixture with the block copolymers and copolycarbonates which are employed in the imaging elements of the invention.

The charge generation and the charge transport layers can be formed by solvent coating, the components of the layer being dissolved or dispersed in a suitable liquid. Useful liquids include aromatic hydrocarbons such as benzene, toluene, xylene and mesitylene; ketones such as acetone and butanone; halogenated hydrocarbons such as methylene chloride, chloroform and ethylene chloride; ethers including cyclic ethers such as tetrahydrofuran; ethyl ether; and mixtures of the above. An especially useful quality of the block copolymers having crystalline side chains is that they are soluble or easily dispersible in these common coating solvents.

Vacuum deposition is also a suitable method for depositing certain layers. The compositions are coated on the conductive support to provide the desired dry layer thicknesses. The benefits of the invention are not limited to layers of any particular thicknesses and they can vary considerably, e.g., as disclosed in the cited references. In general, the charge transport layers are thicker than the charge generation layers, e.g., from 5 to 200 times as thick or from about 0.1 to 15 μm dry thickness, particularly 0.5 to 2 μm. Useful results can also be obtained when the charge transport layers are thinner than the charge generation layer.

The invention has been described in detail with particular reference to preferred embodiments thereof, but it will be understood that variations and modifications can be effected within the spirit and scope of the invention.

We claim:

1. A method of non-electrostatically transferring dry toner particles which comprise a toner binder and have a particle size of less than 8 micrometers from the surface of an element which comprises a conductive support and a surface layer, said surface layer having an electrically insulating polymeric binder resin matrix which comprises a polymer containing polyester repeating units which have crystalline side chains to a receiver which comprises a substrate having a coating of a thermoplastic addition polymer on a surface of the substrate wherein the Tg of the thermoplastic polymer is less than approximately 10° C. above the Tg of the toner binder which comprises:

(A) contacting said toner particles with said thermoplastic polymer coating on said receiver;

(B) heating said receiver to a temperature such that the temperature of said thermoplastic polymer coating on said receiver during said transferring is at least approximately 15° C. above the Tg of said thermoplastic polymer; and (C) separating said receiver from said element at a temperature above the Tg of said thermoplastic polymer, whereby virtually all of said toner particles are transferred from the surface of said element to said thermoplastic polymer coating on said receiver.

2. The method of claim 1, wherein the substrate is paper.

3. The method of claim 1, wherein the substrate is a transparent film.

4. The method of claim 1, wherein the substrate is flexible.

5. The method of claim 1, wherein the thermoplastic addition polymer has a Tg of about 40° C. to about 80° C.

6. The method of claim 1, wherein the thermoplastic addition polymer has a weight average molecular weight of about 20,000 to about 500,00.

7. The method of claim 1, wherein the thermoplastic addition polymer is a poly(alkylacrylate) or a poly(alkylmethacrylate) wherein the alkyl moiety contains from 1 to about 10 carbon atoms.

8. The method of claim 1, wherein the thermoplastic addition polymer comprises a copolymer of styrene or a derivative of styrene and an acrylate.

9. The method of claim 1, wherein the thermoplastic addition polymer comprises a copolymer of styrene or a derivative of styrene and a methacrylate.

10. The method of claim 8, wherein the acrylate is a lower alkyl acrylate having 1 to about 6 carbon atoms and an alkyl moiety.

11. The method of claim 1, wherein the thermoplastic addition polymer is polyvinyl(tolulene-co-n-butyl acrylate).

12. The method of claim 1, wherein the thermoplastic addition polymer is polyvinyl(tolulene-co-isobutyl methacrylate).

13. The method of claim 1, wherein the thermoplastic addition polymer is polyvinyl(styrene-co-n-butyl acrylate).

14. The method of claim 1, wherein the thermoplastic addition polymer is polyvinyl(methacrylate-co-isobutyl methacrylate).

15. The method of claim 1, wherein the toner binder has a Tg of about 40° C. to about 120° C.

16. The method of claim 15, wherein the toner binder has a Tg of about 50° C. to about 100° C.

17. The method of claim 1, wherein the polymer is a crystalline side chain polyester or a block copolyester or block copolycarbonate having a crystalline side chain polyester block.

18. The method of claim 1, wherein the binder resin matrix comprises a polymer containing polyester repeating units of the formula:

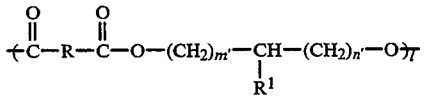

wherein

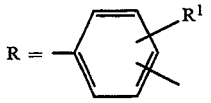

or

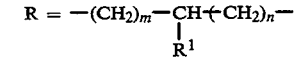

wherein m, n, m′ and n′ are zero or positive integers the sum of m plus n is from 0 to 3, the sum of m′ plus n′ is from 1 to 5, $R^1$ and $R^2$ are crystalline aliphatic hydrocarbon groups or hydrogen, with the proviso that no more than one of such groups is hydrogen, and 1 is an integer from 10 to 100.

19. The method of claim 18, wherein the polyester repeating units amount to about 5 to 50 weight percent of the binder resin matrix.

20. The method of claim 19, wherein the polymer is a polyester.

21. The method of claim 19, wherein the polymer is a block copolyester or block copolycarbonate of which the polyester repeating units form a block.

22. The method of claim 21, wherein the polymer is a block copolyester which is a derivative of one or more dicarboxylic acids and one or more diols, at least one of the acids being an aromatic dicarboxylic acid.

23. The method of claim 21, wherein the binder resin matrix consists of essentially of the block copolymer.

24. The method of claim 21, wherein the binder resin matrix comprises a blend of polyester or polycarbonate binder resin and the block copolymer, the amount of the block copolymer being sufficient to provide an amount in the binder resin matrix of the block which contains crystalline hydrocarbon groups comprising from about 5 to 50 weight percent of the binder resin matrix.

25. The method of claim 1, wherein the element comprises a multilayer element.

26. The method of claim 17, wherein the surface layer contains a photoconductive phthalocyanine pigment.

27. The method of claim 1, wherein the surface layer contains an organic aggregate photoconductive composition.

28. The method of claim 25, wherein the element comprises in sequence a conductive support, a charge generation layer, a first charge transport layer and, as a surface layer, a second charge transport layer.

29. The method of claim 25, wherein the element comprises in sequence a conductive support, a charge transport layer and, as the surface layer, a charge generation layer.

30. The method of claim 28, wherein the charge generation layer contains an aggregate photoconductive composition.

31. The method of claim 20, wherein the binder resin matrix is a blend of poly(ethylene-n-octadecylsuccinate) and a polyester or polycarbonate binder resin.

32. The method of claim 22, wherein the polymer is poly(4,4'-2-norbornylidene)bisphenol-terephthalate-co-azelate)-block-poly(ethylene-2-n-octadecylsuccinate).

* * * * *